US008697617B2

(12) United States Patent
Watts et al.

(10) Patent No.: US 8,697,617 B2
(45) Date of Patent: Apr. 15, 2014

(54) POWER TRANSMISSION FLUIDS WITH IMPROVED FRICTION CHARACTERISTICS

(75) Inventors: Raymond F. Watts, Long Valley, NJ (US); Keith R. Gorda, Little York, NJ (US)

(73) Assignee: Infineum International Limited, Abingdon, Oxfordshire (GB)

( * ) Notice: Subject to any disclaimer, the term of this patent is extended or adjusted under 35 U.S.C. 154(b) by 0 days.

(21) Appl. No.: 12/327,889

(22) Filed: Dec. 4, 2008

(65) Prior Publication Data

US 2009/0131288 A1 May 21, 2009

Related U.S. Application Data

(63) Continuation-in-part of application No. 10/731,800, filed on Dec. 9, 2003, now abandoned.

(51) Int. Cl.
*C10M 133/16* (2006.01)

(52) U.S. Cl.
USPC ..... 508/232; 508/291

(58) Field of Classification Search
USPC ..... 508/232
See application file for complete search history.

(56) References Cited

U.S. PATENT DOCUMENTS

| | | | | | |
|---|---|---|---|---|---|
| 2,412,708 | A | * | 12/1946 | Blair, Jr. | 508/454 |
| 3,382,172 | A | | 5/1968 | Lowe | |
| 3,853,772 | A | | 12/1974 | Adams | |
| 3,912,639 | A | | 10/1975 | Adams | |
| 3,912,643 | A | | 10/1975 | Adams | |
| 4,089,790 | A | | 5/1978 | Adams | |
| 4,396,516 | A | * | 8/1983 | Kinoshita et al. | 508/262 |
| 4,505,835 | A | * | 3/1985 | Sung et al. | 508/515 |
| 5,840,662 | A | * | 11/1998 | Nibert et al. | 508/107 |
| 6,225,266 | B1 | * | 5/2001 | Watts et al. | 508/193 |

OTHER PUBLICATIONS

"Friction of Transmission Clutch Materials as Affected by Fluids, Additives and Oxidation", Rodgers, J. J. and Haviland, M. L., Society of Automotive Engineers paper 194A, 1960.

"Prediction of Low Speed Clutch Shudder in Automotive Transmission Using the Low Velocity Friction Apparatus", Watts, R. F. and Nibert, R. K., Engine Oils and Automotive Lubrication, Marcel Dekker, New York (1992) 732.

* cited by examiner

*Primary Examiner* — Jim Goloboy
(74) *Attorney, Agent, or Firm* — Kenyon and Kenyon LLP

(57) ABSTRACT

Reaction products of maleic and/or succinic acids or anhydrides and primary aliphatic amines are disclosed as effective in reducing the static friction in power transmission fluids.

5 Claims, No Drawings

POWER TRANSMISSION FLUIDS WITH IMPROVED FRICTION CHARACTERISTICS

CROSS-REFERENCE TO RELATED APPLICATIONS

This application is a continuation-in-part of a previous application entitled "Power Transmission Fluids with Improved Friction Characteristics," having Ser. No. 10/731,800 and filed on Dec. 9, 2003 now abandoned.

BACKGROUND OF THE INVENTION

This invention relates to power transmission fluid compositions which exhibit reduced static friction coefficients.

This invention is based on the discovery that reaction products of certain maleic or succinic acids and/or anhydrides and primary $C_4$-$C_{30}$ amines are effective in reducing the static friction levels of such fluids.

Reduction of friction in mechanical devices is one critical aspect of improving their energy efficiency. Reducing friction reduces the amount of energy that is turned into heat which in most devices is radiated to the environment and thereby the energy is lost. Therefore there is a continuing interest in developing chemical compositions that reduce sliding contact friction. In power transmission fluids there is a need not only to lower friction, usually the static friction, but to control that level of friction accurately. An additional aspect of friction control is the maintenance of the desired level friction, that is, once a desirable level of friction is achieved that the established level not vary with aging of the fluid.

For the purposes of this invention a power transmission fluid is defined as any lubricant used in contact with gears involved in the transmission of mechanical energy. In many cases these devices also contain wet clutch systems employing friction materials based on cellulose, polyamides (KEVLAR®), carbon fibers or other composite materials. Commonly these power transmission devices, which may use the fluids of this invention, would include, but not be limited to, automatic transmissions, manual transmissions, continuously variable transmissions, automated manual transmissions, dual clutch manual transmissions, transfer cases, axles and differentials used in mobile applications. They would also include stationary gearing used in industrial applications as well as industrial transmissions.

SUMMARY OF THE INVENTION

In accordance with this invention there has been discovered a power transmission fluid composition which comprises:

(a) a major amount of an oil of lubricating viscosity;

(b) an effective amount of a power transmission fluid performance additive package; and (c) a static friction reducing amount of a reaction product formed by the reaction of maleic or succinic acid or anhydride, or a $C_1$-$C_6$ alkyl substituted maleic or succinic acid or anhydride. with a primary aliphatic amine of the formula R—$NH_2$ wherein R is a $C_4$-$C_{30}$ hydrocarbyl group which does not contain primary amine.

Preferably, the compositions of this invention are formulated for use as automatic transmission fluids.

Further embodiments of this invention comprise power transmission devices, especially an automatic transmission apparatus, containing the fluids of this invention and a method for lubricating such devices using the fluids of this invention.

Lubricating oils contemplated for use in this invention are either natural lubricating oils, synthetic lubricating oils or derived from mixtures of natural lubricating oils and synthetic lubricating oils. Suitable lubricating oils also include basestocks obtained by isomerization of synthetic wax and slack wax, as well as basestocks produced by hydrocracking (rather than by solvent treatment) the aromatic and polar components of the crude. The lubricating oil will have a kinematic viscosity ranging from about 2 to about 20 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

The mineral oils useful in this invention include all common mineral oil basestocks. This would include oils that are naphthenic or paraffinic in chemical structure as well as oils that are refined by conventional methodology using acid, alkali, and clay or other agents such as aluminum chloride, or they may be extracted oils produced, e.g., by solvent extraction or treatment with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

A particularly useful class of mineral oils are those mineral oils that are severely hydrotreated or hydrocracked. These processes expose the mineral oils to very high hydrogen pressures at elevated temperatures in the presence of hydrogenation catalysts. Typical processing conditions include hydrogen pressures of approximately 3000 pounds per square inch (psi) at temperatures ranging from 300° C. to 450° C. over a hydrogenation-type catalyst. This processing removes sulfur and nitrogen from the lubricating oil and saturates any alkylene or aromatic structures in the feedstock. The result is a base oil with extremely good oxidation resistance and viscosity index. A secondary benefit of these processes is that low molecular weight constituents of the feedstock, such as waxes, can be isomerized from linear to branched structures hereby providing finished base oils with significantly improved low temperature properties. These hydrotreated base oils may then be further de-waxed either catalytically or by conventional means to give them exceptional low temperature fluidity. Commercial examples of lubricating base oils made by one or more of the aforementioned processes are Chevron RLOP, Petro-Canada P65, Petro-Canada P100, SK Corporation, Yubase 4, Imperial Oil Canada EHC 35, Fortum Nexbase 3060, and Shell XHVI 5.2.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly(1-decenes), etc., and mixtures thereof]; alkylbenzenes [e.g., dodecylbenzenes, tetradecylbenzenes, dinonylbenzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

The lubricant basestock will have kinematic viscosities of from 2.0 $mm^2/s$ (cSt) to 20.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt), at 100° C.

Power Transmission Fluid Performance Additive Package

The performance additive package will be determined by the desired end use application. In general power transmission fluid performance packages contain anti-oxidants, anti-wear agents, friction modifiers, ashless dispersants, extreme pressure agents, corrosion inhibitors, viscosity modifiers and anti-foamants, each present in customary amounts so as to provide their normal attendant functions, such as 1 to 25 wt. %. The exact amounts and presence or absence of the individual components will be determined by the intended application. Preferred are compositions free of polymeric viscosity modifier.

Automotive Gear Oil—one type of automotive gear oil additive package would contain one or more of a highly sulfurized hydrocarbon or ester, a phosphite or phosphate, corrosion inhibitors, dispersants and anti-foamants. Examples of commercially available gear oil additive packages are: Anglamol 99, Anglamol 6043, Anglamol 6085 from the Lubrizol Corporation; Hitec 320, Hitec 323, Hitec 350 and Hitec 385 from the Ethyl Corporation; Mobilad G-252, Mobilad G-251 and Mobilad G-2001 available from ExxonMobil Chemical Company.

A second type of automotive gear oil additive package consists of colloidally dispersed potassium triborate particles. This technology is described in U.S. Pat. Nos. 3,853,772; 3,912,639; 3,912,643 and 4,089,790. An examples of a commercially available gear oil package based on this technology is OLOA 9151× from Oronite division of Chevron-Texaco Chemical Company.

Automotive gear oil additive packages are normally present from about 1% to about 15% by weight of the finished lubricant.

Manual Transmission Fluid—manual transmission fluids can be directly formulated from specialized additive packages or from reduced treat rates of automotive gear oil packages. Manual transmission fluid additive packages generally contain one or more anti-wear agents, ashless dispersants, corrosion inhibitors, friction modifiers, anti-foamants and sometimes viscosity modifiers. An example of a commercially available manual transmission fluid additive package is Infineum T4804 from Infineum, which contains antifoamant, antioxidant, rust inhibitor, magnesium sulfonate detergent, seal swellant, amine phosphate antiwear additive, borated polyisobutenyl succinimide dispersant and friction modifier, each present in customary amounts so as to provide their normal attendant function.

Manual transmission fluid additives generally comprise from about 1% to about 10% of the weight of the finished lubricant.

Automatic Transmission Fluid—automatic transmission fluid additive packages normally consist of ashless dispersants; anti-wear agents; anti-oxidants; corrosion inhibitors; friction modifiers; seal swell agents; anti-foamants and sometimes viscosity modifiers. Examples of commercially available automatic transmission fluid additives are: Lubrizol 6950; Lubrizol 7900; Lubrizol 9614 from the Lubrizol Corporation; Hitec 403; Hitec 420; Hitec 427 from the Ethyl Corporation and Infineum T4520, Infineum T4540 from Infineum.

Automatic transmission fluid additives normally comprise from about 1 to about 20% of the weight of the finished lubricant.

Representative amounts of additives in an automatic transmission fluid are summarized as follows:

| Additive | Broad Wt. % | Preferred Wt. % |
|---|---|---|
| VI Improvers | 1-12 | 1-4 |
| Corrosion Inhibitor | 0.01-3 | 0.02-1 |
| Dispersants | 0.10-10 | 2-5 |
| Antifoaming Agents | 0.001-5 | 0.001-0.5 |
| Detergents | 0.01-6 | 0.01-3 |
| Antiwear Agents | 0.001-5 | 0.2-3 |
| Pour Point Depressants | 0.01-2 | 0.01-1.5 |
| Seal Swellants | 0.1-8 | 0.5-5 |
| Friction Modifiers | 0.01-10 | 0.1-5 |
| Antioxidants | 0.01-10 | 0.1-5 |

The preferred ashless dispersants for use in the automatic transmission fluid (ATF) performance additive packages of this invention are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 700 to 1200 (preferably 900 to 1100). It has been found that selecting certain dispersants within the broad range of alkenyl succinimides produces fluids with improved frictional characteristics. The most preferred dispersants of this invention are those wherein the polyisobutene substituent group has a molecular weight of approximately 950 atomic mass units, the basic nitrogen containing moiety is polyamine (PAM) and the dispersant has been post treated with a boronating agent.

Preferred antiwear additives for use in the ATF performance additive packages of this invention are the mono-, and di-hydrocarbyl phosphites having the general structure I, where structure I is represented by:

Structure I

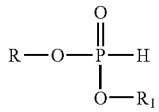

where R is hydrocarbyl and $R_1$ is hydrocarbyl or hydrogen; preferably R or $R_1$ contains a thioether ($CH_2$—S—$CH_2$) group. As used herein, the term "hydrocarbyl" denotes a group having a carbon atom directly attached to the remainder of the molecule and having predominantly hydrocarbon character within the context of this invention. Such groups include the following: (1) hydrocarbon groups; that is, aliphatic, alicyclic (e.g., cycloalkyl or cycloalkenyl), aromatic groups, alkaryl groups, and the like, as well as cyclic groups wherein the ring is completed through another portion of the molecule; (2) substituted hydrocarbon groups; that is, groups containing non-hydrocarbon substituents which in the context of this invention, do not alter the predominantly hydrocarbon nature of the group. Those skilled in the art will be aware of suitable substituents. Examples include, halo, hydroxy, nitro, cyano, alkoxy, acyl, etc.; (3) hetero groups; that is, groups which while predominantly hydrocarbon in character within the context of this invention, contain atoms of other than carbon in a chain or ring otherwise composed of carbon atoms. Suitable hetero atoms will be apparent to those skilled in the art and include, for example, nitrogen, oxygen and sulfur.

Friction modifiers preferably present in the ATF performance additive packages of the current invention are succinimide compounds having the structure II:

Structure II

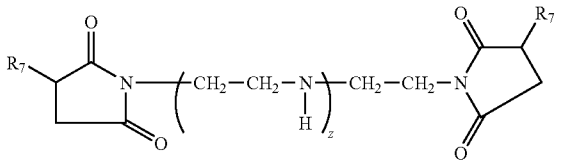

wherein $R_7$ is $C_6$ to $C_{30}$ alkyl, and z=1 to 10.

The alkenyl succinic anhydride starting materials for forming the friction modifiers of structure II can be either of two types. The two types differ in the linkage of the alkyl side chain to the succinic acid moiety. In the first type, the alkyl group is joined through a primary carbon atom in the starting olefin, and therefore the carbon atom adjacent to the succinic acid moiety is a secondary carbon atom. In the second type, the linkage is made through a secondary carbon atom in the starting olefin and these materials accordingly have a branched or isomerized side chain. The carbon atom adjacent to the succinic acid moiety therefore is necessarily a tertiary carbon atom.

The alkenyl succinic anhydrides of the first type, shown as structure III, with linkages through secondary carbon atoms, are prepared simply by heating α-olefins, that is, terminally unsaturated olefins, with maleic anhydride. Examples of these materials would include n-decenyl succinic anhydride, tetradecenyl succinic anhydride, n-octadecenyl succinic anhydride, tetrapropenyl succinic anhydride, etc.

Structure III

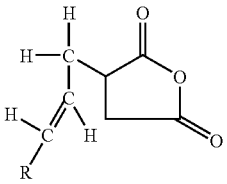

wherein R is $C_3$ to $C_{27}$ alkyl.

The second type of alkenyl succinic anhydrides, with linkage through tertiary carbon atoms, are produced from internally unsaturated olefins and maleic anhydride. Internal olefins are olefins which are not terminally unsaturated, and therefore do not contain the moiety. These internal olefins can be introduced into the reaction mixture

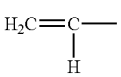

as such, or they can be produced in situ by exposing α-olefins to isomerization catalysts at high temperatures. A process for producing such materials is described in U.S. Pat. No. 3,382,172. The isomerized alkenyl substituted succinic anhydrides are compounds having structure IV:

Structure IV

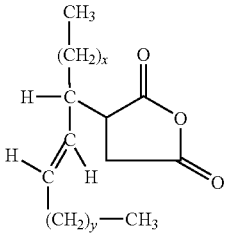

where x and y are independent integers whose sum is from 1 to 30.

The preferred succinic anhydrides are produced from isomerization of linear α-olefins with an acidic catalyst followed by reaction with maleic anhydride. The preferred α-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The preferred succinimide friction modifiers of this invention are products produced by reacting the isomerized alkenyl succinic anhydride with diethylene triamine, triethylene tetramine, tetraethylene pentamine or mixtures thereof. The most preferred products are prepared using tetraethylene pentamine. The alkenyl succinic anhydrides are typically reacted with the amines in a 2:1 molar ratio so that both primary amines are converted to succinimides. Sometimes a slight excess of isomerized alkenyl succinic anhydride is used to insure that all primary amines have reacted. The products of the reaction are compound of structure II.

Ethoxylated amine friction modifiers are also useful in the ATF performance additive packages of the current invention and these are compounds having structure VI:

Structure VI

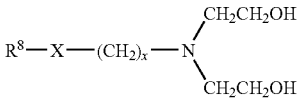

wherein $R_8$ is a $C_6$ to $C_{28}$ alkyl group, X is O, S or $CH_2$, and x=1 to 6.

Alkoxylated amines are a particularly suitable type of friction modifier for use in this invention. Preferred amine compounds contain a combined total of from about 18 to about 30 carbon atoms. In a particularly preferred embodiment, this type of friction modifier is characterized by structure VI where X represents oxygen, $R_8$ contains a total of 18 carbon atoms, and x=3.

Other useful friction modifiers for the fluids of this invention are primary amides of long chain carboxylic acids represented by the structure: $RCONH_2$ wherein R is preferably an alkenyl or alkyl group having about 12 to 24 carbons, R is most preferably a $C_{1-7}$ alkenyl group. The preferred primary amide is oleamide. Oleamide is preferably present in an amount between about 0.001 to 0.50 wt. %, based upon the weight percent of the fully formulated oil composition, most preferably present in an amount of 0.1 wt. %.

Another preferred component of the additive system of the current invention is a shear stable viscosity modifier. Viscosity modifiers are oil soluble polymers used to thicken lubricants at high temperatures while causing minimal thickening at low temperatures. Suitable viscosity modifiers include hydrocarbyl polymers and polyesters. Examples of suitable hydrocarbyl polymers include homopolymers and copolymers of two or more monomers of $C_2$ to $C_{30}$, e.g., $C_2$ to $C_8$ olefins, including both α-olefins and internal olefins, which may be straight or branched, aliphatic, aromatic, alkyl-aromatic, cycloaliphatic, etc. Frequently the viscosity modifiers will be copolymers of ethylene with $C_3$ to $C_{30}$ olefins, particularly preferred being the copolymers of ethylene and propylene. Other polymers can be used, such as polyisobutylenes, homopolymers and copolymers of $C_6$ and higher α-olefins, polypropylene, hydrogenated polymers and copolymers and terpolymers of styrene, e.g., with isoprene and/or butadiene.

The metal detergents which may be used in the ATF performance additive packages of the compositions of this invention may be oil-soluble neutral or overbased alkali metal or alkaline earth metal, preferably calcium or magnesium, salts of one or more of the following acidic substances (or mixtures thereof): (1) sulfonic acids, (2) carboxylic acids, (3) salicylic acids, (4) alkyl phenols and (5) sulfurized alkyl phenols.

Suitable antioxidants for use in combination in the ATF performance additive package compositions of the present invention include amine-type and phenolic antioxidants. Examples of amine-type antioxidants include phenyl alpha naphthylamine, phenyl beta naphthylamine and bis-alkylated diphenyl amines (e.g., p,p'-bis(alkylphenyl)-amines wherein the alkyl groups each contain from 8 to 12 carbon atoms). Phenolic antioxidants include sterically hindered phenols (e.g., 2,6-di-tert-butylphenol, 4-methyl-2,6-di-tert-butylphenol) and bis-phenols (e.g., 4,4"-methylenebis(2,6-di-tert-butylphenol). Another class of useful phenolic antioxidants are the derivatives of cinnamic acid and cinnamic acid esters (e.g., the octyl ester of 3,5-dimethyl-4-hydroxyl cinnamic acid). Phosphorous compounds, such as ZDDP, or phosphites are also commonly added to power transmission fluids as antioxidants.

Suitable corrosion inhibitors for use in the ATF performance additive packages of this invention include zinc dialkyl dithiophosphate, phosphosulfurized hydrocarbons, thiadiazoles such as 1,3,4-thiadiazoles and $C_2$-$C_{30}$ hydrocarbyl substituted derivatives thereof, benzotriazole and $C_1$-$C_8$ alkyl substituted benzotriazoles, such as tolyltriazole and hexylbenzotriazole, or their reaction products with monoamines and polyamines.

Suitable seal swellants for use in the ATF performance additive packages of this invention include aliphatic alcohols of 8 to 13 carbon atoms, such as tridecyl alcohol; and oil soluble aliphatic or aromatic hydrocarbon esters of 10 to 60 carbon atoms and 2 to 4 linkages, such as dihexyl phthalate, and alkoxyl sulfolane derivatives such as 3-isodecyloxy-sulfolane.

The compositions of this invention will contain 0.01 to 10 wt. % of a reaction product formed by the reaction of a maleic or succinic anhydride, or their di-acid equivalents, with an amine which does not contain a primary amine of the formula R—$NH_2$ wherein R is a $C_4$-$C_{30}$ hydrocarbyl group, saturated or unsaturated, substituted or unsubstituted. Suitable substituent hetero atoms include halogen, nitrogen, silicon, phosphorus, oxygen and sulfur. Preferably R is a $C_{12}$-$C_{22}$ alkyl group such as octadecyl. While these reaction products consist essentially of cyclic di-imides other reaction products may be present as well. Maleimides are preferred. These imides cause a reduction in static friction to a desired low level.

In a non-limiting embodiment of the invention, the static friction reducing member is a succinimide having a closed ring.

In another non-limiting embodiment of the invention, the static friction reducing member is the reaction product of greater than 2 moles of amine and 1 mole of maleic anhydride. For example, the static friction reducing member is the reaction product of at least 2.2 moles of amine and 1 mole of maleic anhydride. As another example, the static friction reducing member is the reaction product of at least 2.5 moles of amine and 1 mole of maleic anhydride. For a further example, the static friction reducing member is the reaction product of at least 3 moles of amine and 1 mole of maleic anhydride.

EXAMPLES

Examples A, B, E and F illustrate the static friction reducing additive of the invention. Examples C and D are comparative examples which were evaluated in the table below.

Example A

A four necked round bottom flask was fitted with an air driven stirrer, a water cooled condenser filter with dean stark trap, thermometer, and nitrogen introduction tube. Into the flask was placed 1 mole (98.1 gm) of maleic anhydride which was heated to melting. 1 mole (267.5 gm) of octadecyl amine was introduced to the melt via dripping funnel over a 1 to 2 hour period in order to control reaction exotherm. After amine addition, the reaction mixture was mixed at 100° C. for one hour, followed by a two hour nitrogen sweep at 160° C. The mixture was cooled and decanted. Yield: 347 gm. Elemental analysis of the product: N, 3.96% (4.03% theoretical).

Example B

The procedure of Example A was repeated except that the following materials and amounts were used: 1 mole (114.1 gm) of methyl succinic anhydride with 1 mole (267.5 gm) octadecyl amine. Yield: 363 gm. Elemental analysis of the product: N, 3.83% (3.85% theoretical).

Example C

The procedure of Example A was repeated except that the following materials and amounts were used: 1 mole (178.2 gm) of methyl-5-norbornene-2,3-dicarboxylic anhydride with 1 mole (267.5 gm) octadecyl amine. Yield: 427 gm. Elemental analysis of the product: N, 3.30% (3.27% theoretical).

Example D

The procedure of Example A was repeated except that the following materials and amounts were used: 1 mole (154.2 gm) of 1,2-cyclohexane-dicarboxylic anhydride with 1 mole (267.5 gm) octadecyl amine. Yield: 403 gm. Elemental analysis of the product: N, 3.53% (3.47% theoretical).

Example E

The procedure of Example A was repeated except that the following materials and amounts were used: 1 mole (98.1 gm) of maleic anhydride with 1 mole (185.4 gm) dodecyl amine. Yield: 265 gm. Elemental analysis of the product: N, 5.46% (5.23% theoretical).

Example F

The procedure of Example A was repeated except that the following materials and amounts were used: 1 mole (100.1 gm) of succinic anhydride with 1 mole (185.4 gm) dodecyl amine. Yield: 267 gm. Elemental analysis of the product: FTIR Spectroscopy.

To demonstrate the efficiency of the claimed compositions at reducing static friction, several test fluids were made and the friction measured by Low Velocity Friction Apparatus. This technique is described in detail in references such as, "Friction of Transmission Clutch Materials as Affected by Fluids, Additives and Oxidation", Rodgers, J. J. and Haviland, M. L., Society of Automotive Engineers paper 194A, 1960 and "Prediction of Low Speed Clutch Shudder in Automotive Transmission Using the Low Velocity Friction Apparatus", Watts, R. F. and Nibert, R. K., Engine Oils and Automotive Lubrication, Marcel Dekker, New York (1992) 732, both of which are incorporated herein by reference. The friction data reported in Table 1 is taken at 120° C. after slight aging in the test rig.

All fluids contained the same levels of an automatic transmission fluid additive package comprising ashless dispersant, anti-oxidants, anti-wear agents and viscosity modifier. The blends were made in a common mineral oil base fluid, ExxonMobil solvent 100 neutral oil.

TABLE 1

| | Fluid | | | | |
|---|---|---|---|---|---|
| COMPONENTS MASS % | 1 | 2 | 3 | 4 | 5 |
| Product of Example A | — | 2.00 | — | — | — |
| Product of Example B | — | — | 2.00 | — | — |
| Product of Example C | — | — | — | 2.00 | — |
| Product of Example D | — | — | — | — | 2.00 |
| Exxon 100N Base oil plus other additives | To 100.0 | To 100.0 | To 100.0 | To 100.0 | To 100.0 |
| Static Coefficient of Friction at 120° C. | 0.135 | 0.117 | 0.082 | 0.136 | 0.136 |

Table 1 shows the formulation of the tested products and the static coefficient of friction at 120° C. measured on each blend. Each product was added to the test oil at a treat rate of 2.0 mass %. Fluid 1 is a blank, it contained no added friction modifier.

Relative to the blank, Fluid 1, the two fluids containing products of the invention, Fluids 2 and 3, exhibited significantly reduced static friction coefficients. The two fluids containing products that are similar to the claimed products, i.e. they contain succinimides of a long chain amine, Fluids 4 and 5, exhibit no reduction in static friction coefficient.

What is claimed:

1. A method for reducing the static coefficient of friction of a power transmission fluid composition which comprises:

(a) adding a static friction reducing member comprising a succinimide formed from a reaction of maleic or succinic acid or anhydride with a primary aliphatic amine of the formula R—$NH_2$ wherein R is a $C_{12}$-$C_{22}$ alkyl group to a power transmission fluid comprising a major amount of an oil of lubricating viscosity; and an effective amount of a power transmission fluid performance additive package, wherein the succinimide is present in an amount of 0.01 to 10 wt. % of the composition; and (b) lubricating a power transmission with said fluid, whereby the static friction coefficient of the fluid is reduced.

2. The method according to claim 1 wherein the succinimide is derived from a maleic acid or anhydride.

3. The method according to claim 1 wherein the amine is octadecyl amine.

4. The method according claim 1 wherein the power transmission fluid is for an automatic transmission apparatus.

5. The method according to claim 1 wherein the static friction reducing member is a reaction product of at least 2.5 moles of amine and 1 mole of maleic anhydride.

* * * * *